US005561509A

United States Patent [19]

Kazakoff

[11] Patent Number: 5,561,509

[45] Date of Patent: Oct. 1, 1996

[54] MONODIRECTIONALLY PLATING DEVELOPER ELECTRODE FOR ELECTROPHOTOGRAPHY

[75] Inventor: James A. Kazakoff, Boise, Id.

[73] Assignee: Hewlett-Packard Company, Palo Alto, Calif.

[21] Appl. No.: 526,726

[22] Filed: Sep. 11, 1995

[51] Int. Cl.[6] ..... G03G 15/06; G03G 15/10

[52] U.S. Cl. ..... 355/261; 355/256; 355/262; 355/265; 118/647; 118/648; 118/659

[58] Field of Search ..... 355/256, 261, 355/262, 264, 265; 118/648, 647, 659, 660

[56] References Cited

U.S. PATENT DOCUMENTS

| | | | |
|---|---|---|---|
| Re. 30,535 | 3/1981 | Kuroishi et al. | 118/648 X |
| 4,035,071 | 7/1977 | Miyakawa et al. | 355/265 |
| 4,247,195 | 1/1981 | Okamoto et al. | 118/647 X |
| 4,400,079 | 8/1983 | Landa | 355/256 |
| 4,423,134 | 12/1983 | Miyakawa et al. | 118/647 X |
| 4,623,241 | 11/1986 | Buchan et al. | 355/256 |
| 4,748,934 | 6/1988 | Mochizuki et al. | 118/651 |
| 4,833,500 | 5/1989 | Mochizuki et al. | 355/256 |
| 5,034,778 | 7/1991 | Levannon et al. | 355/296 |
| 5,157,443 | 10/1992 | Anderson et al. | 355/256 |
| 5,255,058 | 10/1993 | Pinhas et al. | 355/256 |
| 5,262,828 | 11/1993 | Oka et al. | 355/265 |

*Primary Examiner*—Matthew S. Smith

[57] ABSTRACT

Embodiments are shown and described of an electrode biasing scheme and developer design for use with liquid electrophotographic imaging machines. The biasing scheme includes a bi-modal charge transport characteristic, wherein the time constant for reverse-plating is prolonged compared to the time constant for forward-plating. This characteristic may be achieved with a diode between the developer electrode and bias voltage source. The preferred developer design is a micro-developer, having a plurality of electrode micro-regions that each adapt in bias to match the photoconductor voltage profile. The invented developer electrode design significantly reduces the backplating of toner on the electrode surface, and can be used to lengthen the available development time period for a given electrophotographic process.

16 Claims, 11 Drawing Sheets

$$V_{OPC}(t) = \frac{R_{OPC}}{R_T + R_{OPC}} V_{DEV} + \left[V_{CHARGE} - \frac{R_{OPC}}{R_T + R_{OPC}} V_{DEV}\right] EXP\left(\frac{-t^*(R_{OPC} + R_T)}{R_{OPC} R_T C_{OPC}}\right)$$

FIG.3B $$V_{OPC}(t) = \frac{R_{OPC} V_{DEV}}{(R_T + R_{DIODE} + R_{OPC})} + [V_{CHARGE} - \frac{R_{OPC} V_{DEV}}{(R_T + R_{DIODE} + R_{OPC})}]EXP(\frac{-t(R_{OPC} + R_T + R_{DIODE})}{R_{OPC}(R_T + R_{DIODE}) C_{OPC}}$$

FIG.6B

MONODIRECTIONALLY PLATING DEVELOPER ELECTRODE FOR ELECTROPHOTOGRAPHY

FIELD OF THE INVENTION

This invention relates, generally, to an electrode biasing scheme for use in electrophotography. More specifically, the invention relates to a developer design which reduces backplating of toner on the electrode surface and can lengthen available development time for a given electrophotography process.

RELATED ART

Development Process

FIG. 1 shows a simplified description of a generalized electrophotographic print engine 10. The photoconductor 12 comprises a conductive drum coated with a photoconductive coating, which allows storage of a persistent charge across small elements of its surface 14. The photoconductor surface 14 is initially charged to some potential $V_C$ at the charging station 16, referenced to the conductive drum. A modulated light beam at the exposure station 18 is then moved across the photoconductor surface 14, selectively discharging regions. Regions which are to receive toner are discharged to some residual voltage $V_D$, whereas regions which are to remain un-toned (white) retain a voltage near the initial charge level, $V_C$. This selective exposure forms a latent image on the photoconductor surface 14.

After leaving the exposure station 18, the exposed area of the photoconductor is rotated past a developer station 20. The developer station 20 comprises an electrode 22, separated by a small gap from the photoconductor surface. Fluid toner 24, containing charged pigment particles, is brought up to fill the gap, forming a nip 26 between the surfaces of the photoconductor and the developer electrode. The electrode 22 is biased to a voltage $V_{DEV}$ referenced to the conductive drum, forming an electric field in the region of the electrode. In this region, and, in particular, in the region of the toner nip 26, a nominally conductive path through the toner exists. The strength and vector direction of the electric field varies in relationship to the charge level of the regions of the photoconductor surface 14. In the exposed regions, where the photoconductor surface is at a lower potential than the electrode, the toner particles, being positively charged, are induced to migrate toward the photoconductor surface. Conversely, in the unexposed regions, where the photoconductor surface voltage is at a higher potential than the electrode, the toner particles are driven away from the photoconductor surface and toward the electrode surface 28. Lateral electric fields exist at the photoconductor surface, independent of the developer electrode, in edge regions of the image, where exposed and unexposed areas are adjacent. The effective field at the region is the vector sum of the source components.

The build-up of toner particles at either the photoconductor surface 14 or electrode surface 28 constitutes toner plating. Forward-plating at the photoconductor surface develops the latent image on the photoconductor surface 14, whereas the negative image forms on the developer electrode surface 28 due to reverse-plating. The amount of plating that occurs is proportional to the charge transport at each respective surface. Integration of current flow at each region, over the time of development, gives some measure of plating.

Control of development determines the quality of the resulting image and the printed product from the image transfer station 30 and the efficiency and cost effectiveness of the process. Plating beyond a threshold thickness provides no further improvement in optical density, and degrades the efficiency of the system by unnecessarily depleting toner particles from solution. Conversely, insufficient plating prevents full image definition due to the lack of optical density. Therefore, it is desirable to understand and efficiently control the development process in a developer implementation scheme so as to optimize image quality and toner utilization.

Developer Electrode Designs

Generally speaking, most developer electrode implementations used to date can be categorized as either conventional fixed plate or rotary cylinder designs. The fixed plate design comprises a conductive element which conforms to the shape of the photoconductive surface such that the surface of the electrode is equidistant at all points from the adjacent photoconductive surface. The rotary electrode design comprises a rotating conductive cylinder that is located next to the photoconductor surface.

In the fixed-plate design, toner is injected into the gap between the two surfaces, possibly by positive pressure or by application to the moving photoconductor surface at the leading edge of the developer electrode. One advantage to this design is that the width of the developer is nearly the exact width of the electrode plate (exclusive of the toner supply mechanism) and has no moving parts. This allows a compact developer station footprint, which occupies a minimum space around the periphery of the photoconductor surface. However, a major disadvantage of this design is that backplating occurs on the surface of the plate, impeding its operation. Periodic cleaning of this electrode surface is therefore required.

In the rotary electrode developer design, toner is typically applied to the surface of the cylindrical electrode, which then rotates the toner into the gap between the electrode and the photoconductor, forming a nip. This can be achieved by using the cylinder as a plenum, immersing a lower portion of the cylinder in a toner bath. The rate of toner delivery is then regulated by the rotation rate of the electrode. An advantage of the rotary electrode design is that the backplated toner can be removed from the surface of the electrode at an area away from the development zone, such as with a scraping blade or squeegee, and returned to the toner supply reservoir.

A major disadvantage of the rotary design is that the width of the nip, that is, the development region, is relatively narrow compared to the diameter of the electrode cylinder. The gap between photoconductor and electrode surfaces is not equidistant at all points within the nip, thus the electric field strength at the photoconductor surface is not uniform in the development region. The resulting developer assembly is therefore typically designed to be relatively large, and requires a large area in the periphery of the photoconducting surface. Large-diameter electrode cylinders also are more stiff, providing better gap tolerance, and holding a more uniform toner nip. For higher throughput EP systems, which require a wider development region, large-diameter electrode cylinders, or a series of smaller ones connected in tandem, must be used.

Hybrid developer designs, which utilize a rotating conductive belt fitted around multiple rollers, as discussed in Anderson. et al (U.S. Pat. No. 5,157,443), have been used to achieve the advantages of both conventional schemes, however these designs are obviously much more complex.

Development Process Model

A simple one-dimensional electrical model of the conventional development process is shown by the schematic in FIG. 2, and can be used to describe the surface voltage at a single point of the photoconductor during development. A resistor (RT) models the toner in the nip region of the developer, and a resistor/capacitor combination ($C_{opc}$–$R_{opc}$) model the photoconductor. The model assumes that the electric field is uniform throughout the development region, and the electric field is normal to the surface of the photoconductor. In addition, the toner supply and concentration is assumed constant and uniform in density throughout the nip. Toner deposition is assumed proportional to the charge transport.

Prior to time $T_0$ (switch position 1), a point region on the photoconductor is charged to some assumed steady-state potential. The value of this potential is dependent upon whether the point is an exposed region ($V_{CHARGE}=V_D$) or unexposed region ($V_{CHARGE}=V_C$) of the image. At time To (switch position 2), the region of the photoconductor enters the nip and begins development. At time $T_F$ (switch position 3), the point exits the development nip.

The step response voltage of this example conventional development system is shown and described in FIGS. 3A and B. This graph shows the photoconductor surface voltage during development, for both an exposed region and a non-exposed region. The surface potential of both the exposed and the unexposed regions tends toward a steady-state voltage $V_{SS}$ as development progresses. Exposed regions approach $V_{SS}$ from $V_D$ where $V_D < V_{SS}$, and non-exposed regions approach $V_{SS}$ from $V_C$, where $V_C > V_{SS}$. For a sufficiently wide development region, the photoconductor surface reaches equilibrium of $V_{SS}$ in all regions, where $V_{SS} < V_{DEV}$. The photoconductor is then said to have "developed to completion".

The value of the developer electrode bias voltage is chosen so as to maximize the amount of forward-plating occurring in the exposed regions during the development period. However, $V_{DEV}$ must be chosen small enough to prevent "greying" or unintentional background development of the unexposed, non-image regions of the photoconductor. If $V_{DEV}$ is higher than the voltage of the non-image regions, either at the start of development or as the non-image region charge decays during development, then the development field direction vector reverses to cause the "greying" or background development of the non-image regions.

Typically, a photoconductor exhibits some charge leakage, or persistent conductance, which is modeled by resistor $R_{OPC}$. This conductance has a significant impact on the performance of the electrophotographic system. For an ideal photoconductor, charge is drained off only during exposure, and the conductance of all regions is zero otherwise, particularly prior to and during development ($R_{OPC}=\infty$). In this ideal case, the final steady-state voltage $V_{SS}$ is exactly $V_{DEV}$, and $V_{DEV}$ can be made large, with $V_{DEV} = V_C$. Examining the step response for these conditions reveals that, for an ideal photoconductor, no backplating of the electrode surface occurs in non-image regions ($V_C$–$V_{DEV}$=0), no background development occurs, and all charge transport results in plating of image regions. Furthermore, once the photoconductor has reached a steady-state surface voltage, development is complete, and no further plating can occur, regardless of the duration of the development region.

For non-ideal photoconductors, however, the leakage resistance $R_{opc}$ is finite, and the system behavior is much different from the ideal case. First, the steady-state voltage $V_{SS}$ is less than $V_{DEV}$, due to a steady-state current flow while in the development field. This condition requires that the development period be terminated prior to the unexposed, non-image photoconductor surface voltage decaying below $V_{DEV}$, to prevent forward-plating in these non-image areas. For example, in the process shown in FIG. 3A, the development period would be terminated at about 20–25 msec, at a point at which the surface potential of the photoconductor has not reached steady-state.

It is also necessary to consider the coupling between adjacent regions of the photoconductor. Without considering a more complicated model, it is sufficient to recognize that each region will have a different initial surface voltage value, and a different leakage resistance, thus producing a different step response. In addition, adjacent regions of different surface potential result in lateral electric fields within the development area. Therefore, the development response characteristic is image-dependent.

Thus, considering all possible photoconductor regions, there are ranges of surface voltages and ranges of response characteristics. To prevent background development, it is necessary to reduce the development bias level such that $V_{DEV} < V_{CMIN}$, where $V_{CMIN}$ is the smallest unexposed, non-image surface potential of any point on the photoconductor. Reducing $V_{DEV}$, however, reduces the amount of plating in image regions, and causes developer backplating to occur for most non-image regions, since $V_{CMAX} - V_{DEV} > 0$, where $V_{CMAX}$ is the largest surface voltage of all photoconductor points. (See FIG. 4).

If the development nip region is limited in length such that development is terminated prior to background development occurring, the image typically must be fixed to prevent further development. Development is preferably terminated slightly before $V_C$ decays below $V_{DEV}$, at a time when the voltage of the unexposed regions ($V_C$) is greater than the voltage of the exposed regions ($V_D$). Since the photoconductor surface voltage is not at a steady-state value, a secondary development can occur due to lateral electric fields existing in edge regions of the image, in the absence of the developer bias field. Any residual toner present on the photoconductor outside the electric field of the development zone can result in this uncontrolled secondary development. The image can be fixed or neutralized in the following ways:

1. Follow the developer with a fixing station, consisting of charge conducting carrier with no toner pigment, and allow the development to continue to completion, as discussed in Pinas, et al. (U.S. Pat. No. 5,255,058).

2. Follow the developer with a second developer, or second electrode, in which the developer bias has been reduced. The first developer somewhat overdevelops the image. The second developer allows the image to slightly reverse-develop, thereby cleaning any overdeveloped regions.

The development model characteristics are summarized in Table 1, and the tradeoffs of the developer bias voltage setting are summarized in Table 2.

TABLE 1

| Photoconductor voltage ranges and their effect on development | |
|---|---|
| DEVELOPMENT EFFECT | REQUIRED PHOTOCONDUCTOR CONDITION |
| Developer Electrode Backplating | $V_c > V_{DEV}$ |
| Background Development (Non-Image) | $V_{DEV} > V_c > V_{ss}$ |
| Image Development | $V_{DEV} > V_{ss} > V_D$ |

TABLE 2

| Impact of changing developer bias voltage on electrophotographic process, showing increases (↑) and decreases (↓) in EP parameters | | | |
|---|---|---|---|
| $V_{DEV}$ | OPTICAL DENSITY (IMAGE PLATING) | DEVELOPER ELECTRODE BACKPLATING | EQUIVALENT DEVELOPMENT TIME* |
| ↑ | ↑ | ↓ | ↓ |
| ↓ | ↓ | ↑ | ↑ |

(*Without background development)

SUMMARY OF THE INVENTION

An object of the present invention is to modify the biasing system of the conventional developer described above so as to significantly limit the backplating of toner on the developer electrode from unexposed regions of the photoconductor surface. The invented monodirectional-toner-plating system, also called a "monodirectional developer system", 40 is schematically shown in FIG. 5, represented by a model having a diode 42 between the developer electrode 44 and the bias voltage source 67. The effect of this biasing scheme is to provide a bi-modal charge transport characteristic, wherein the time constant for reverse-plating is prolonged compared to the time constant for forward-plating. This characteristic allows choosing a development bias level $V_{DEV}$ that is higher than that possible when using the conventional biasing scheme, without causing background development.

The monodirectional-plating system of this invention may be illustrated by considering the two extreme cases of photoconductor surface images. In the first case, in which the image consists entirely of exposed regions, the monodirectional system performs nearly equivalently to a developer system with no diode. In the second case, in which the image consists entirely of unexposed regions, the monodirectional system minimizes or prevents reverse-plating on the electrode.

In the first case, as the exposed regions pass through the developer 40, the photoconductor surface 14 voltage is approximately $V_D$. Since this is less than the bias potential $V_{DEV}$, the diode 42 is forward-biased and conducts, so that nearly all of the voltage difference $V_{DEV}-V_D$ is developed across the toner 24. Current flow and therefore toner plating are forward, that is, in the direction of the photoconductor surface 14 in a manner similar to a system that has no diode.

In the second case, as unexposed regions pass through the developer 40, the photoconductor surface 14 voltage is approximately $V_C$. Since this is greater than the bias potential $V_{DEV}$, the diode 42 is reverse-biased and does not conduct. Nearly all of the voltage difference $V_{DEV}-V_C$ develops across the diode 42. Thus, the developer electrode 44 voltage floats to a potential near the photoconductor surface 14 potential $V_C$. Since there is little voltage difference developed across the toner 24, little or no reverse-plating occurs on the developer electrode surface 46.

The step response for the photoconductor surface voltage, for one embodiment of the monodirectionally-plating developer electrode system, is shown and described in FIGS. 6A and B. This graph uses the same system parameters as those used for the conventional system of FIGS. 2 and 3. FIG. 6A shows that, when the electrode backplate current is limited by the diode, the point of time at which $V_C$ crosses $V_{DEV}$ is much later than when no backplate limiting is done. In FIG. 6A, for example, the point of time at which $V_C$ crosses $V_{DEV}$ is at about 40–45 msec, compared to about 20–25 msec in FIG. 3A. Voltage vs. time values for other embodiments of monodirectional systems may vary from the values reported in FIG. 6A, depending, for example, on the voltage and dimension characteristics of the systems.

Because the typical photoconductor surface image is a combination of exposed and unexposed regions, the monodirectional system performance is typically not as ideal as illustrated by the above first and second cases. In operation, the electrode is allowed to float to the average potential of the image region contained within the developer nip. If the image is mostly exposed regions with a few unexposed regions, the average surface potential of the photoconductor will be approximately $V_D$, and the diode will conduct, holding the electrode at $V_{DEV}$. Any of the few unexposed regions within the nip area, which will have a higher potential than $V_{DEV}$, will reverse-plate to the electrode as before. Conversely, an image which is mostly unexposed regions with some exposed regions, the average photoconductor surface potential is nearly $V_C$. The diode is reverse-biased and thus the electrode potential will float up to nearly this $V_C$ potential. This provides a high development bias voltage for all image regions under development, and the level of development is greater than it would be with a fixed development bias.

If the electrode voltage of the monodirectional system is allowed to float too high, undesirable background development of some of the unexposed regions can occur. As noted earlier, the photoconductor surface voltage can vary from unexposed region to unexposed region or at the edges of the unexposed regions. This variation between or within unexposed regions results in a situation where the electrode voltage $V_{CAVE}$ can exceed the surface potential of the relatively lower-voltage unexposed regions ($V_{CAVE}>V_{CMIN}$), and background development (forward-plating) occurs. This problem can be eliminated by limiting the maximum potential that the electrode is allowed to achieve. A diode (or series of diodes) with a reverse break-down voltage $V_R$ (Zener diode) such that $V_R< V_{CMIN}$ will provide this regulation. Bias regulation schemes are disclosed in Miyakawa, et al (U.S. Pat. No. 4,400,079). Two implementations of this are schematically shown in FIG. 7 and FIG. 8.

A preferred embodiment of the monodirectional system comprises a micro-developer, which has a plurality of micro-regions or micro-plates that each adapts in bias potential to match the voltage profile of a small region of the photoconductor surface. The invented monodirectional micro-developer allows a higher development bias voltage, without causing background development and without backplating.

BRIEF DESCRIPTION OF THE DRAWINGS

FIG. 3B is an equation representing the step response for the conventional development process of FIG. 2.

FIG. 6B is an equation representing the step response for the monodirectional-toner-plating system of FIG. 6A.

DETAILED DESCRIPTION OF PREFERRED EMBODIMENT

Referring to FIGS. 9–12, there is shown the preferred, but not the only, embodiment of the monodirectional-toner-plating system of the invention. This preferred embodiment is a micro-developer system 50, which eliminates the problems encountered with conventional systems and which eliminates the limitations encountered with a simple, single-plate monodirectional developer. A simple single-plate monodirectional developer biasing scheme is partially effective in reducing the amount of reverse-plating occurring on the developer electrode, and, thus, reduces the need for a cleaning mechanism or procedure to remove the accumulation of back-plated toner. However, as noted above, there is still some reverse-plating with the single-plate monodirectional system, because the developer electrode potential adapts to, that is, floats to become about equal to, the average potential of the photoconductor surface within its field, and its backplate-limiting characteristic must be restricted so as to prevent background development. In addition, the development adapts on average according to the topology of the image, and the resulting optical density of toned image areas may appear uneven over the total image. Thus, results from a single-plate monodirectional developer may vary depending upon the topology of each image.

The preferred micro-developer scheme overcomes the limitation of the single-plate system. The purpose of this micro-developer design is to provide a developing electrode which can adapt the bias potential at each micro-region of its surface appropriately, to match the voltage profile of the photoconducting surface. In other words, the bias potential at each micro-region adapts to match the voltage of the corresponding micro-region on the photoconductor surface. "Corresponding micro-region" herein means the region of photoconductor surface passing in front of the developer micro-region at a given time. The electrode allows forward-plating, and resists reverse-plating at each region, as necessary. Because of this capability, it is possible to use a higher development bias voltage than otherwise possible, without causing background development and without backplating to the developer electrode. The requirement for cleaning the electrode of deposited toner is significantly reduced, and may be necessary only after cycle down, ie., when the EP apparatus is taken off-line.

Figure 9:
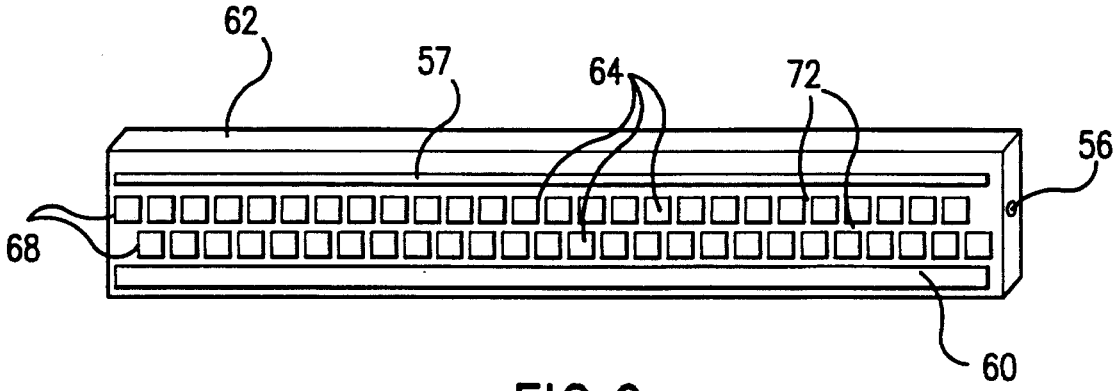
FIG. 9 is a schematic front perspective view of one embodiment of a micro-developer system according to the invention.
Figure 10:
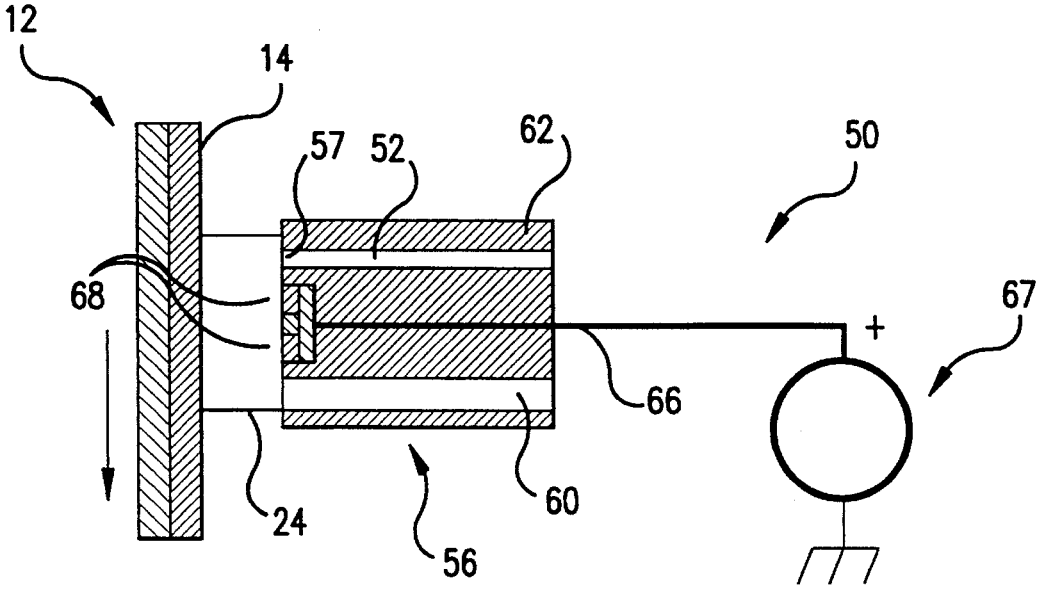
FIG. 10 is a schematic side view of the micro-developer of FIG. 9 shown in relation to a photoconductor and a bias voltage supply.

The micro-developer system 50 shown in FIGS. 9 and 10 comprises a liquid toner delivery system and a developer electrode. A side view of the developer 50, showing its position in relation to the photoconductor 12 is shown in FIG. 10. Liquid toner 24 is injected through a thin slotted manifold 52 ahead the region separating the electrode 56 and the photoconducting surface 14, which is moving past the face of the developer 50. It is important that the manifold opening or port 57 be as near as possible to the developing electrode 56. The motion of the photoconductor and a low pressure of the toner injection system cause the fluid to be carried into the electrode region, which is held away from the photoconductor 12 by gapping spacers at the ends of the developer (not shown). This forms a nip between the photoconductor 12 and the developer surface containing the electrode 56. The toner 24 passes the electrode region and enters the exhaust vent 60, which is held at a negative pressure (vacuum). Most of the residual toner liquid 24 is removed and can be returned to a toner reservoir, to be recycled to the developer 50. The manifold housing 62, containing the electrode 56, is constructed of a non-conducting material, such as plastic. The electrode 56 is formed from segments or tiles 64 of semiconducting silicon. The tiles form an array of diodes which have the anode commonly connected through a conducting bar. An insulated wire 66 running through the manifold housing 62 allows connection of the electrode 56 with its bias supply voltage 67. The exposed surfaces 68 of the diode tiles 64 forms the electrode surface.

Although the design of this developer system 50 is described assuming a positive charge carrier for the toner particles, a similar design could be achieved for toner which use a negative charge carrier. Throughout this description and the claims, developer systems are assumed to be adaptable for either positive or negative charge carriers.

Since it is not practical to create a monolithic silicon electrode of sufficient dimensions for the developer, it is possible to create the necessary sized electrode 56 through a composite of semiconductor tiles 64. The tiles 64 may be joined side to side by any non-conducting cement, which is not reactive with the toner 24 or carrier and insulates the tile surfaces 68 from each other. The width of the electrode can be extended by combining two or more rows of tiles 64. It is desirable to overlap the seams 72 between tiles so that there are no gaps in the developed image region. The seams 72 should be small as compared with the areal resolution of the image. For example, the tiles 64 are expected to be, preferably, but not necessarily about 1 mm×1 mm, and separated by seams 72 of about 0.05 mm or less. For example, an 11 inch-wide, 2-row developer 50 would contain about 558 tiles. The dimensions of the tiles 64 and the seams 72 will be dependent upon the tile material and the process voltages used.

It is well known in the art that the concentration of toner throughout the development region must remain high enough so as to provide sufficient plating for the desired optical density. Additional toner supply ports 57, may be interleaved between the rows of electrode tiles 64 to provide a fresh supply of toner concentration at each point along the developer region. The number of rows can be designed to meet the requirements of the electrophotographic process.

Figure 11:
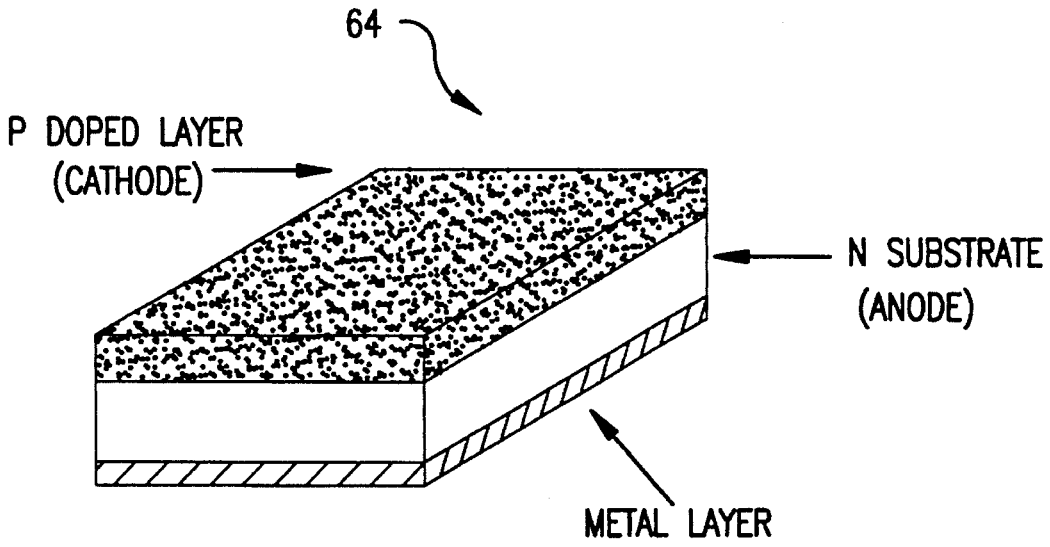
FIG. 11 is a perspective view of one embodiment of an electrode tile, with no metal layer coating, for use in the invented micro-developer of FIG. 9.

In the preferred embodiment of the invention, the cathode surface 68 of the electrode tiles 64 is doped silicon, and has no metal layer coating, as shown in FIG. 11. In this case, the electric field presented to the photoconductor is determined regionally by the depletion region within the diode tile 64. The areal dimensions of the tile are not important, however, the design of the diode and the depth of its diffused doped regions determine the depletion region characteristics and the reverse break-down voltage of the tile. The reverse break-down voltage of the semiconductor should be greater than the charge potential used on the photoconductor, since this scheme does not experience a problem with background development.

Figure 12:
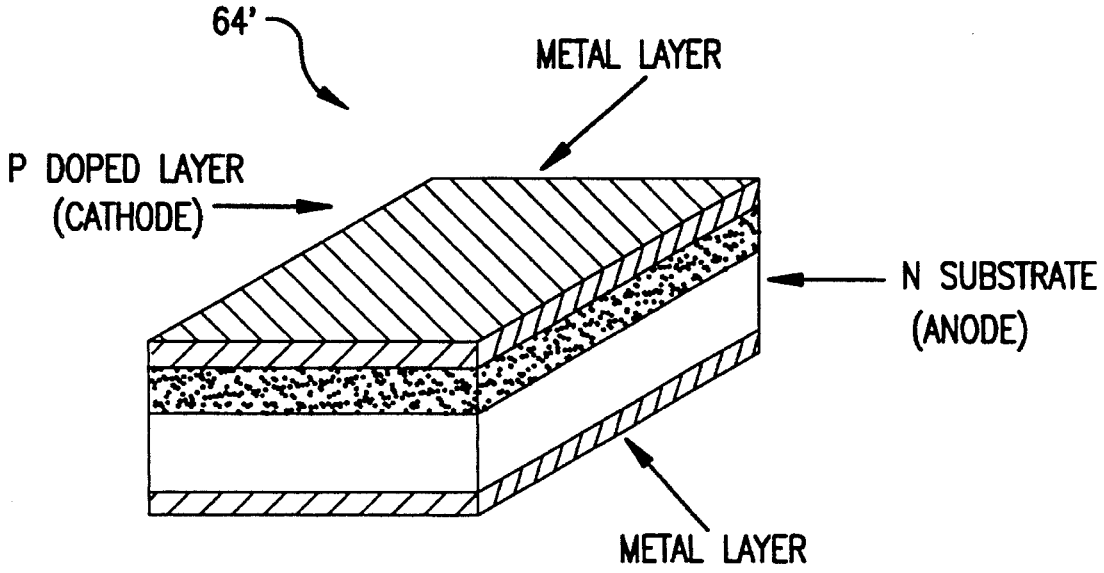
FIG. 12 is a perspective view of another embodiment of an electrode tile, with a metal layer on the cathode, for use in the invented micro-developer.

An alternative embodiment of the invention uses conventional diode chips for tiles 64', which have a metal layer on the cathode, as shown in FIG. 12. In this implementation, the areal size of the diode tile determines the region over which the photoconductor voltage will average to establish the electrode surface voltage for the individual tile. Thus, to gain independence between regions of the image it is desirable to make the area of each tile surface small, and insulate between the tiles to decouple them. The peak surface voltage of the tile may need to be limited, as described earlier, by controlling the reverse break-down voltage characteristics of the tile.

Figure 1:
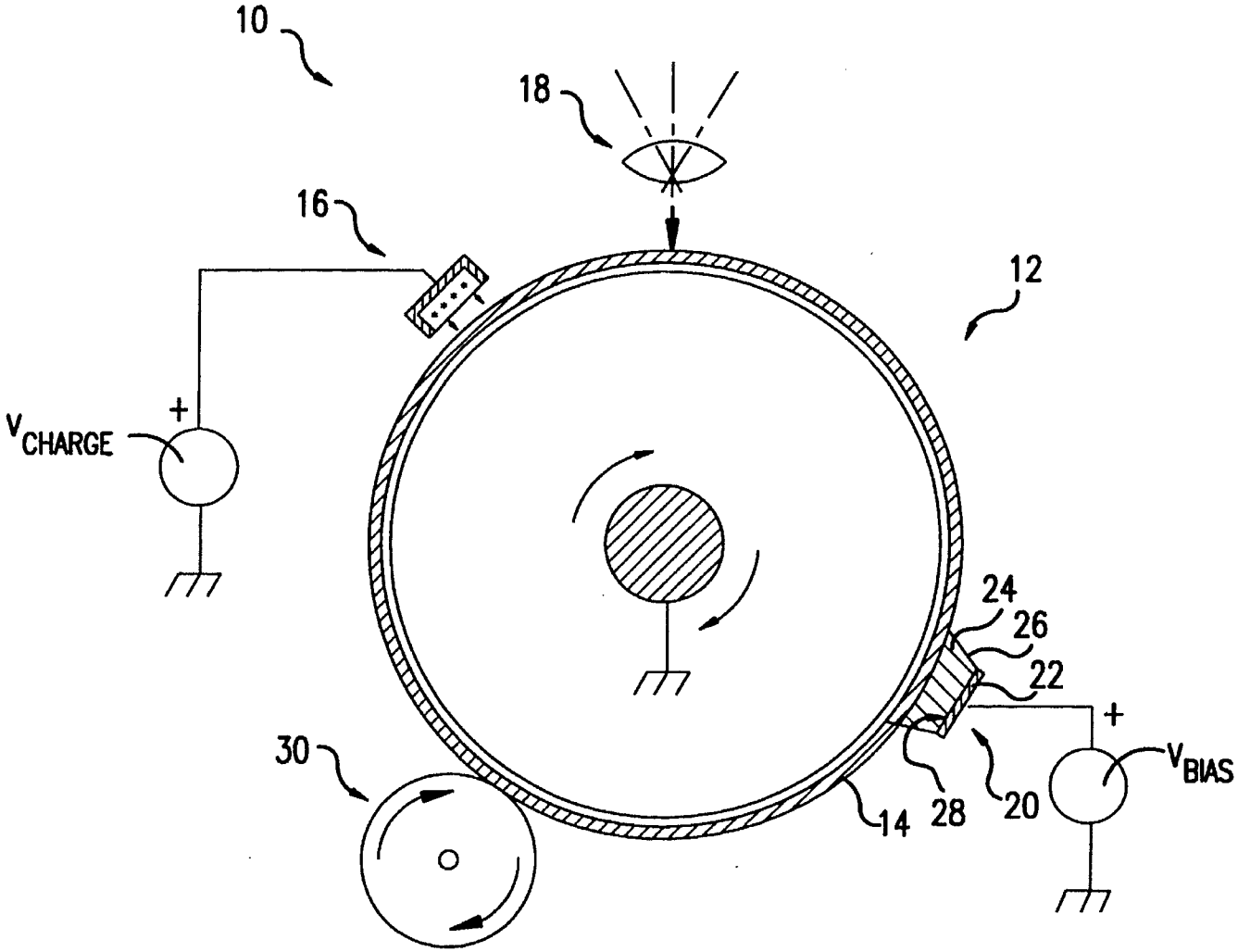
FIG. 1 is a schematic view of a simplified, generalized electrophotographic print engine.
Figure 2:
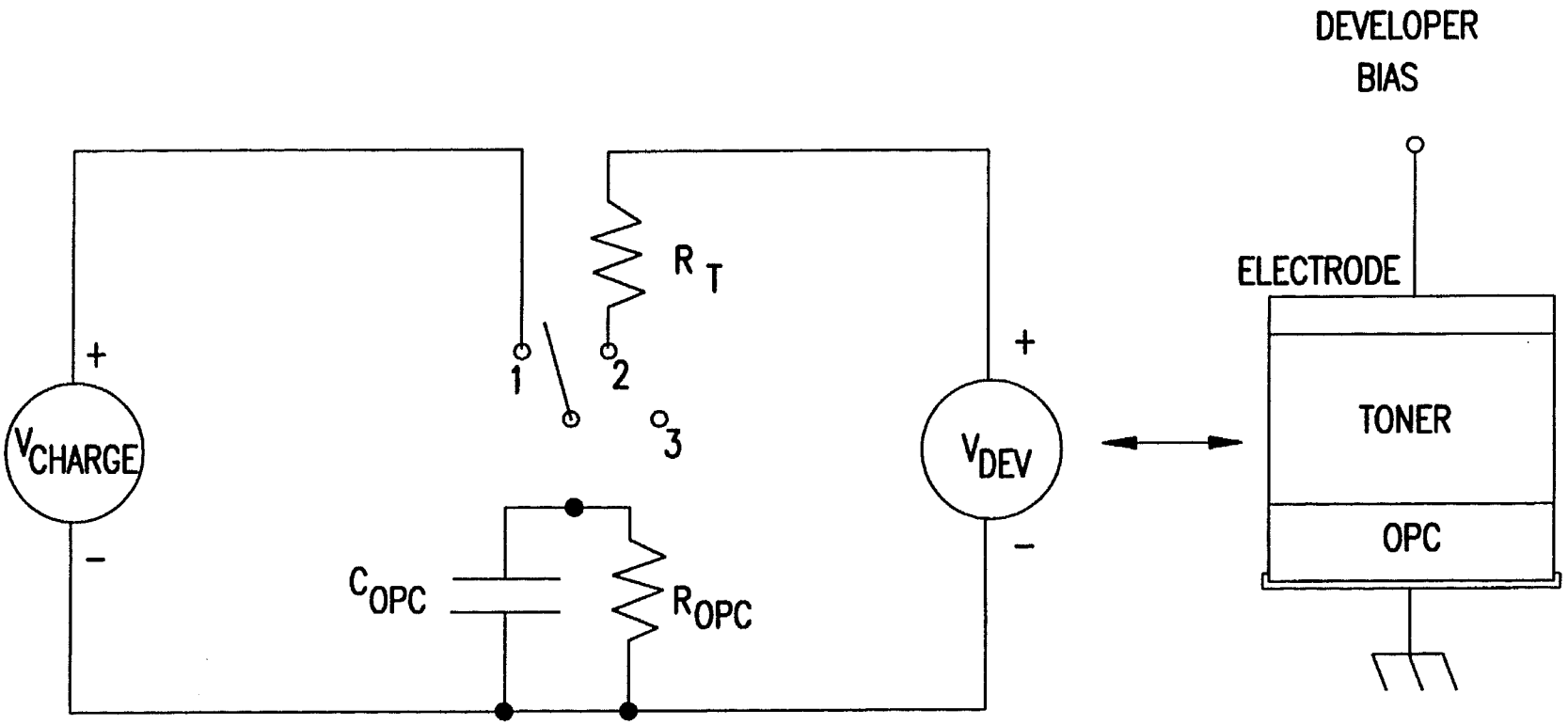
FIG. 2 is a schematic view of a one-dimensional electrical model of a conventional development process.
Figure 3A:
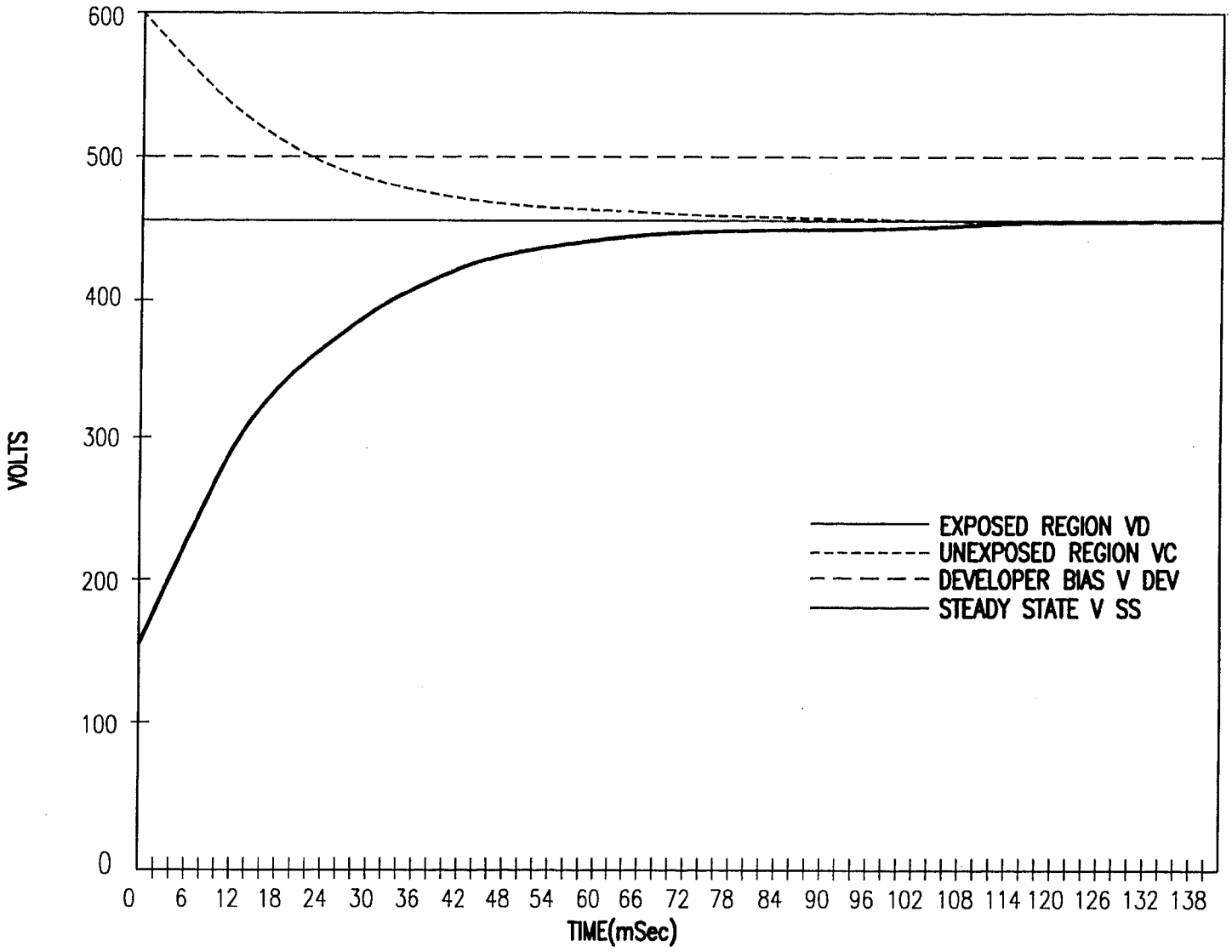
FIG. 3A is a graph of voltages vs. time for the step response of the conventional development process of FIG. 2.
Figure 4:
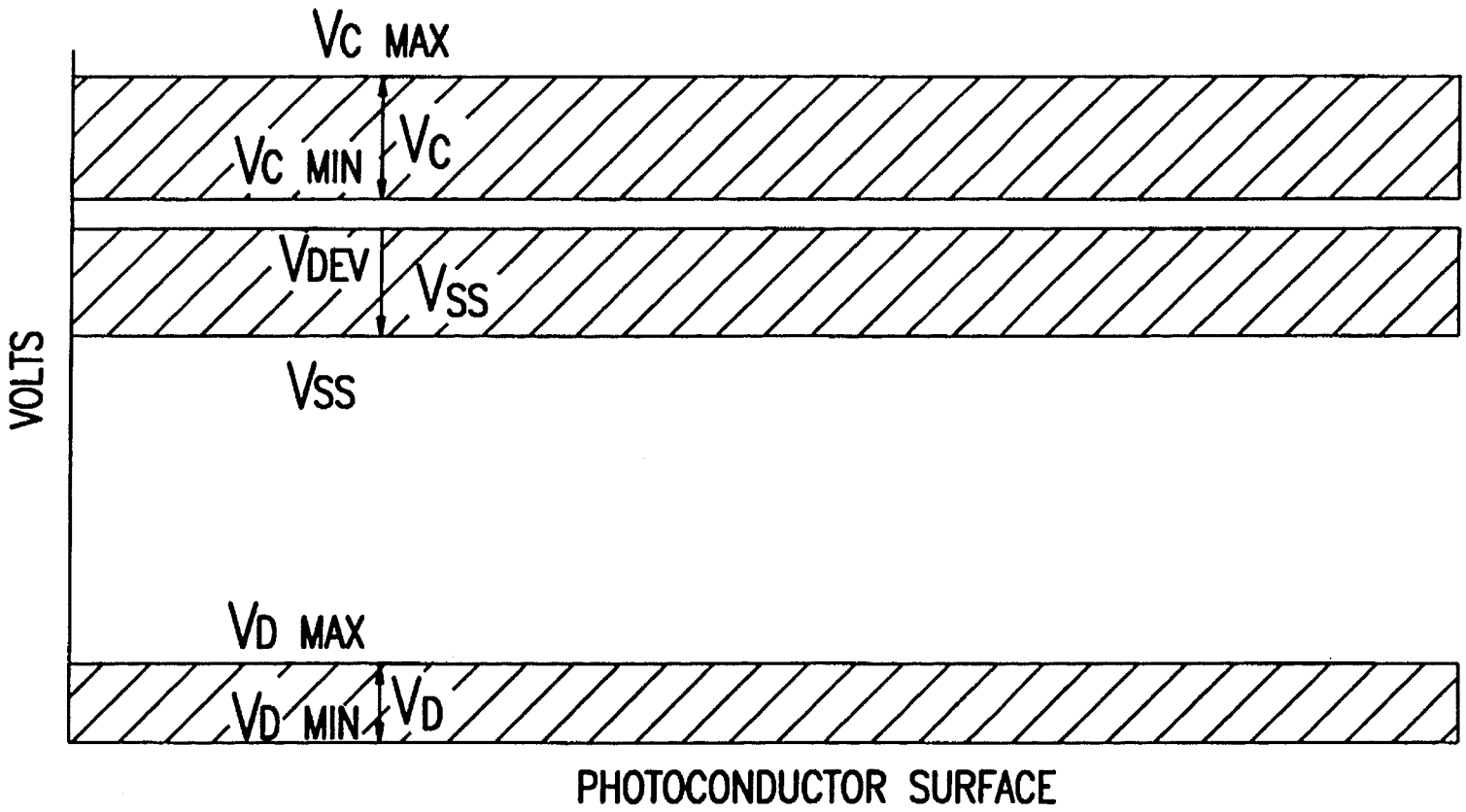
FIG. 4 schematically shows photoconductor surface voltages for a conventional development process, wherein the development bias level is reduced below the smallest unexposed, non-image surface potential on the photoconductor.
Figure 5:
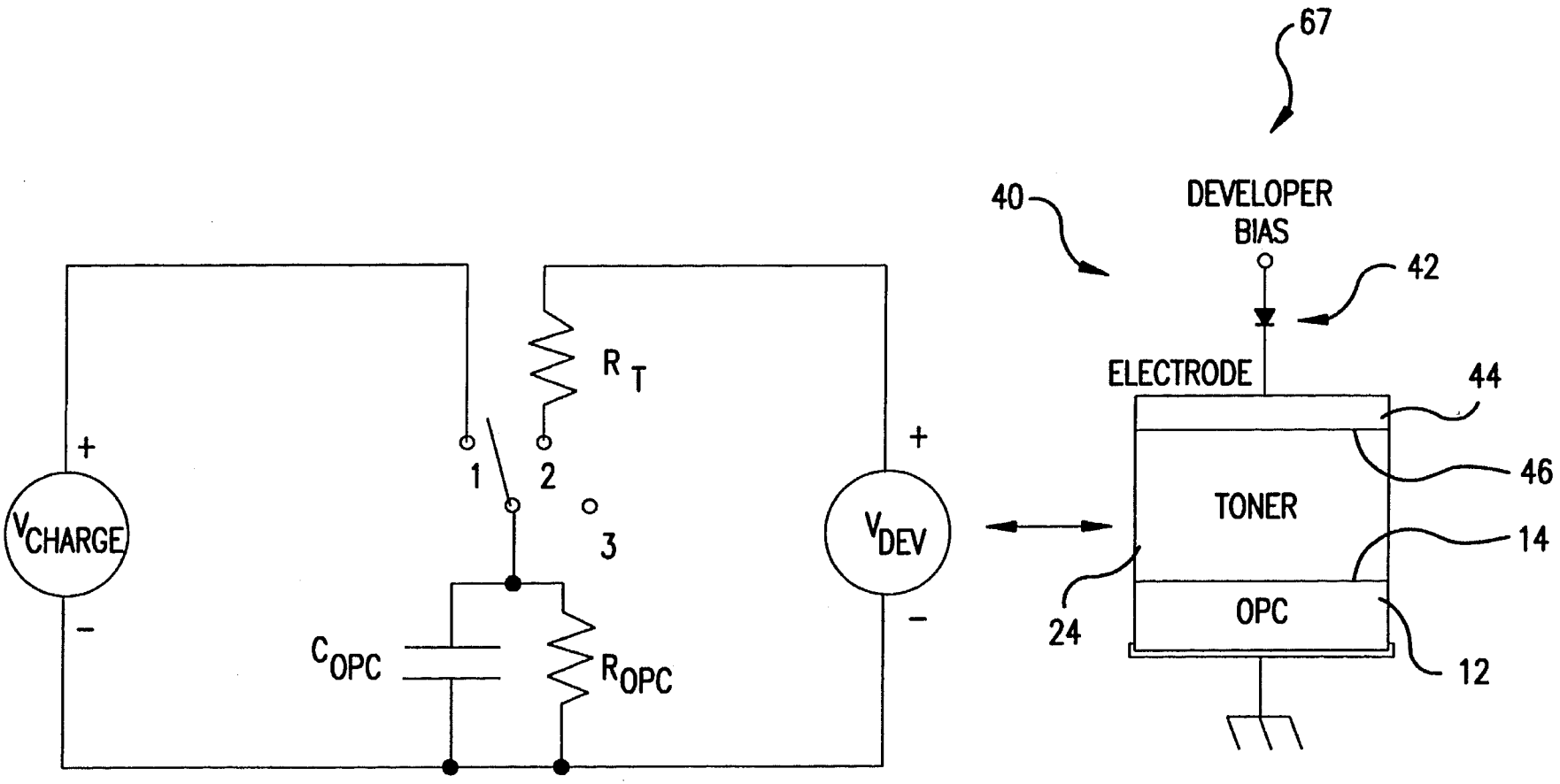
FIG. 5 is a schematic model of one embodiment of the monodirectional-toner-plating system according to the invention.
Figure 6A:
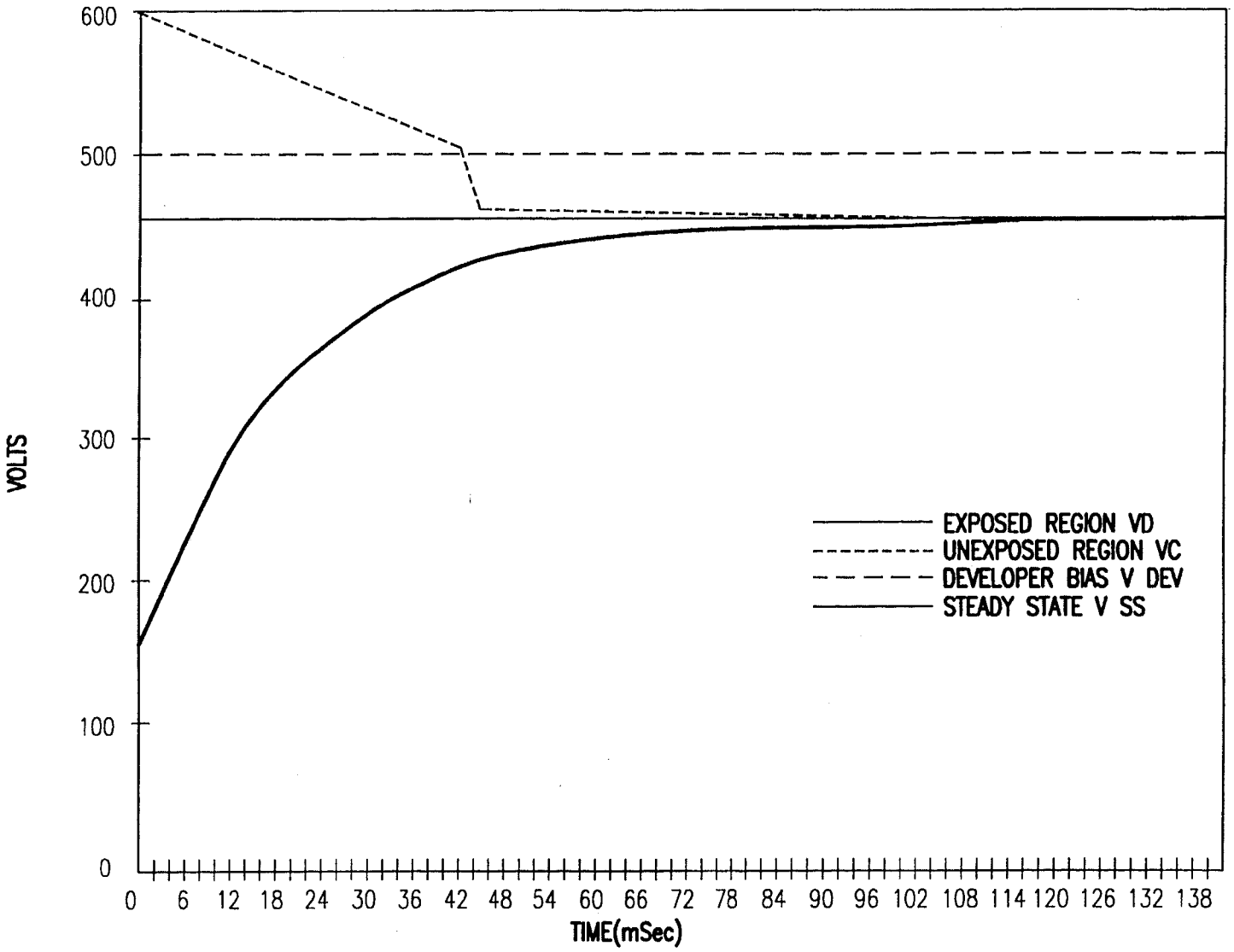
FIG. 6A is a graph of voltages vs. time for the step response of one embodiment of the monodirectional-toner-plating system.
Figure 8:
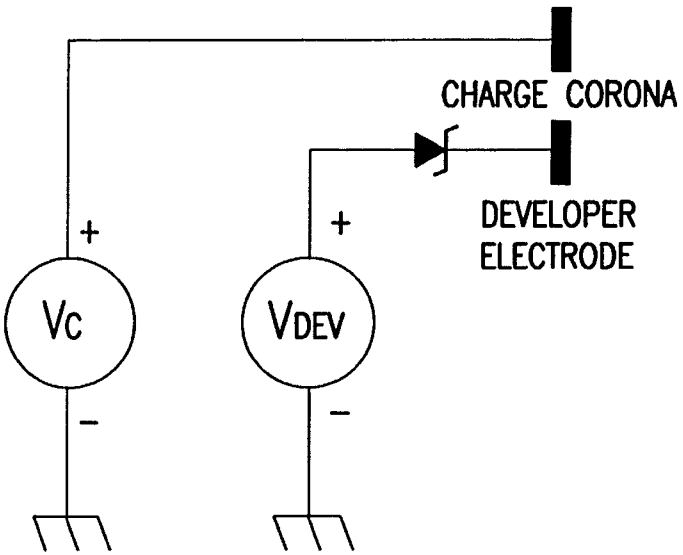
FIG. 8 is a schematic model of another embodiment of a bias regulation scheme that may be used in the invented monodirectional development system.
Figure 7:
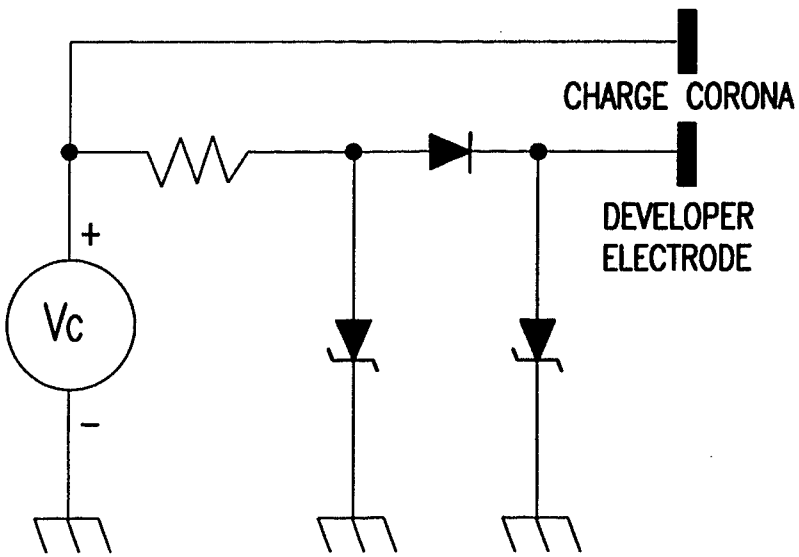
FIG. 7 is a schematic model of one embodiment of a bias regulation scheme that may be used in the invented monodirectional development system.

The gap distance between the electrode surface 68 and the photoconductor surface 14, relative to the exposure region resolution, is significant and determines the sensitivity of the electrode field voltage profile. For example, the systems portrayed by FIGS. 3A and 6A use a gap distance of 0.004 inches. The gap is dependent on characteristics of the photoconductor, such as photoconductor thickness. Because of machining tolerances of the photoconductor drum and of other components, gap distances are typically greater than or equal to about 0.004 inches.

For either diode design, the switching speed of the semiconductor is probably not significant, since the development process is relatively slow.

An interesting feature of this system occurs if the developer bias supply is designed so that it can be electrically switched off. When the bias supply voltage is set to 0 volts, the semiconducting electrode is reverse-biased at each and every region of the photoconductor, thus non-conducting. This causes the surface of the electrode to float to a potential which is near that of the adjacent surface of the photoconductor. Since there is little potential difference across the toner gap, little or no toner migration occurs. A potential difference does exist in edge regions of the image, but these differences are lateral, not orthogonal, to the surfaces of the electrode and photoconductor. In addition, the potential is nearly isometric in the direction orthogonal to the surfaces, hence toner migration occurs only laterally. Consequently, little or no plating occurs on either surface. This, in effect, allows electrical isolation of the developer from the EP system, however, it is with some loss of latent image definition.

Optionally, in a system similar to the shut-off option, an electrode consisting of multiple rows of tiles 64 can have their rows, or any sets of tiles, decoupled from one another, each with an independent bias voltage supply. The term "set" herein refers to any segment or section of the electrode, that is, either a single tile, a row of tiles, or any group of tiles. This decoupling and independent voltage supply system allows tuning of the development region by controlling the voltages of the voltage supplies of the various sections of the electrode. "Controlling" includes deactivating a set of tiles by setting the voltage at zero volts and/or adjusting the voltage of a set of tiles to various voltage levels. Thus, this independent control may provide a different bias voltage at different regions of the developer, for example, for purposes of "fixing" the image.

Advantages of this micro-developer invention include the following:

It eliminates reverse-plating on the developer electrode. This significantly simplifies the developer design, eliminating the need for a moving electrode and cleaning devices or cleaning cycles.

It allows using a "plate" style electrode design. This significantly narrows the footprint of the developer station assembly, requiring less space around the photoconducting surface. Similarly, the width of the development region, i.e., the electrode can be scaled to the requirements of the desired photoconductor velocity, without greatly increasing the size of the developer station as is required with a rotary developer. The developer electrode has no moving parts, thus simplifying its construction.

It results in using a relatively high development bias potential, yielding higher plating for an equivalently-sized development region. Alternatively, for an equivalent level of plating, it allows either a narrower development zone, or a faster photoconductor velocity. A faster photoconductor velocity allows creating a machine with greater page throughput.

It allows more tolerance to a degrading photoconductor, which has developed significant persistent conductance characteristics. Thus, this scheme may allow a longer usable life for the photoconductor before it must be replaced.

It allows dynamical "tuning" of the developer region by controlling the bias voltage on each segment or row of the developer electrode. A zero voltage on an electrode segment or row nearly removes its effects on the electric field, and therefore removes it from the developer system.

Although this invention has been described above with reference to particular means, materials and embodiments, it is to be understood that the invention is not limited to these disclosed particulars, but extends instead to all equivalents within the scope of the following claims.

What is claimed is:

1. A monodirectional electrophotographic developer system comprising:

a. an electrode having an electrode surface;

b. a bias voltage source electrically connected to the electrode for producing a bias potential on the electrode surface; and, c. a diode electrically connected between the said electrode surface and the bias voltage source for preventing reverse current flow from the electrode surface toward the bias voltage source for preventing reverse-toner-plating onto the electrode surface.

2. A developer system as set forth in claim 1, wherein the diode comprises a Zener diode having a reverse breakdown voltage function allowing reverse current flow when the electrode surface bias potential reaches the said reverse breakdown voltage.

3. A monodirectional electrophotography developer system for developing an image represented by a charge profile on a photoconductor surface, the developer system comprising:

a. an electrode comprising a semiconducting tile having a tile surface; and b. a bias voltage source electrically connected to the electrode for producing a bias potential on the tile surface;

c. wherein the semiconducting tile is adapted to prevent current flow from the tile surface toward the bias voltage source when the said tile is reverse-biased, for preventing reverse toner-plating onto the tile surface.

4. A developer system as set forth in claim 3, wherein the electrode further comprises a plurality of semiconducting tiles, each being positioned near a region of the photoconductor surface having a charge profile and an average potential, wherein each tile surface adapts in bias potential to the said charge profile of the said photoconductor surface region by the said bias potential becoming about equal to the average potential of the said region of the photoconductor surface.

5. A developer system as set forth in claim 4, wherein the semiconducting tiles comprise silicon tiles.

6. A developer system as set forth in claim 5, wherein the tile surface of each silicon tile comprises doped silicon without a metal layer coating.

7. A developer system as set forth in claim 4, wherein the said surfaces of the said semiconducting tiles are electrically insulated from each other.

8. A developer system as set forth in claim 4, further comprising a plurality of bias voltage sources, each electrically connected to a different set of said tiles, wherein each bias voltage source is adapted to be independently controlled to produce different voltage bias potentials on the tile surfaces of the said different sets of tiles.

9. A developer system as set forth in claim 3, wherein the semiconducting tile comprises a silicon tile.

10. A developer system as set forth in claim 9, wherein the tile surface of the silicon tile comprises doped silicon without a metal layer coating.

11. A method of developing an electrophotographic image represented by a charge profile on a photoconductor surface, the method comprising:

a. providing a time-constant for forward-plating of toner onto the photoconductor surface; and b. providing a time-constant for reverse-plating of toner on an electrode surface that is longer than the said forward-plating time constant.

12. A method of developing an electrophotographic image as set forth in claim 11, wherein the step of providing a time-constant for reverse plating comprises electrically connecting a bias voltage source to the electrode surface and electrically connecting a diode between the electrode surface and the bias voltage source, for preventing current flow from the electrode surface to the bias voltage source.

13. A method of developing an electrophotographic image as set forth in claim 11, further comprising:

a. positioning a semiconducting tile having a tile surface near the photoconductor surface;

b. electrically connecting a bias voltage source to the tile surface; and c. reverse-biasing the semiconducting tile to prevent current flow from the tile surface to the bias voltage source.

14. A method as set forth in claim 13, further comprising:

a. positioning a plurality of semiconducting tiles, each having a tile surface, so that each tile surface is near a region of the photoconductor surface having a charge profile and an average potential; and b. electrically connecting a bias voltage source to each of said tile surfaces;

c. wherein each tile surface adapts in bias potential to the said charge profile of the said photoconductor surface region by the said bias potential becoming about equal to the average potential of the said region of the photoconductor surface.

15. A method as set forth in claim 14, further comprising electrically insulating the said surfaces of the said semiconducting tile from each other.

16. A method as set forth in claim 14, further comprising electrically connecting a plurality of bias voltage sources each to a different set of said tiles and independently controlling each bias voltage source to produce different voltage bias potentials on the tile surfaces of the said different sets of tiles.

* * * * *